United States Patent [19]

Isoya

[11] Patent Number: 4,472,322

[45] Date of Patent: Sep. 18, 1984

[54] VARIABLE VENTURI CARBURETOR

[75] Inventor: Yukinori Isoya, Nagoya, Japan

[73] Assignee: Aisan Kogyo Kabushiki Kaisha, Japan

[21] Appl. No.: 530,340

[22] Filed: Sep. 8, 1983

[30] Foreign Application Priority Data

Nov. 1, 1982 [JP] Japan ..... 57-166869

[51] Int. Cl.[3] ..... F02M 9/06

[52] U.S. Cl. ..... 261/44 C; 261/DIG. 38

[58] Field of Search ..... 261/44 C, 44 B, DIG. 38

[56] References Cited

U.S. PATENT DOCUMENTS

| | | | |
|---|---|---|---|
| 3,342,463 | 9/1967 | Date et al. | 261/44 C |
| 3,653,642 | 4/1972 | Lawrence | 261/44 C |
| 3,896,195 | 7/1975 | Harrison | 261/44 C |

FOREIGN PATENT DOCUMENTS

| | | | |
|---|---|---|---|
| 696477 | 9/1940 | Fed. Rep. of Germany | 261/44 B |
| 57-65843 | 4/1982 | Japan | 261/44 C |

*Primary Examiner*—Tim Miles

*Attorney, Agent, or Firm*—John E. Benoit

[57] ABSTRACT

A variable venturi carburetor comprising an air passage provided in a suction piston, a needle mounting member provided at the head portion of the suction piston for mounting a fuel metering needle and an air discharging member provided at the needle mounting member, wherein the air passage communicates the air intake passage upstream of a venturi portion with the needle mounting member and is communicated with the venturi portion through the air discharging member.

7 Claims, 9 Drawing Figures

VARIABLE VENTURI CARBURETOR

BACKGROUND OF THE INVENTION

This invention relates to a variable venturi carburetor for use with an internal combustion engine of an automotive vehicle.

As shown in FIG. 1, a conventional variable venturi carburetor for use with an internal combustion engine of an automotive vehicle includes a carburetor body 1 provided with a barrel 2 forming an air intake passage 3 therein and with a cylindrical suction chamber 4 on the barrel 2, the suction chamber 4 being closed at its one end. A lateral through-hole 2*a* is opened through the barrel 2 and a small diameter portion 7 of a suction piston 5 is inserted through the through-hole 2*a*, while a head portion 7*a* of the small diameter portion 7 projects into the air intake passage 3. A large diameter portion 6 of the suction piston 5 is accommodated in the suction chamber 4 and is adapted to slide on the inner circumference of the suction chamber 4. A base portion 8*a* of a tapered fuel metering needle 8 is attached to the head portion 7*a* of the small diameter portion 7 of the suction piston 5. A main nozzle 9 is mounted to a disc plate 16 which is attached to the inner surface of the barrel 2 in opposed relation with the head portion 7*a* of the suction piston 5. A tip portion 8*b* of the metering needle 8 is inserted through the main nozzle 9 and is projected into a fuel chamber 11 which is provided on the upper side of a float chamber 10. The main nozzle 9 is communicated with the fuel chamber 11 through a main jet 12. A fuel pipe 13 is attached to the lower side of the fuel chamber 11 in the vicinity of the main jet 12 and the lowermost end of the fuel pipe 13 is positioned in the fuel F stored in the float chamber 10.

There is provided a compression spring 14 in the suction chamber 4 to normally urge the suction piston 5 in the direction of the main nozzle 9, thereby defining an air chamber 15 between the outer surface of the barrel 2 and the large diameter portion 6 of the suction piston 5 when the compression spring 14 is compresssed. By the forward movement of the suction piston 5, a venturi portion 3*a* is defined between the head portion 7*a* of the small diameter portion 7 of the suction piston 5 and the nozzle mount disc 16 of the main nozzle 9, and the air intake passage 3 upstream of the venturi portion 3*a* is communicated with the air chamber 15 through an air hole 17. A negative pressure chamber 18 is defined between the suction chamber 4 and the large diameter portion 6 of the suction piston 5 and is communicated with the venturi portion 3*a* through a suction hole 19. A throttle valve 20 is provided in the air intake passage 3 just downstream of the venturi portion 3*a*. Reference numeral 21 indicates a float provided in the float chamber 10.

When the throttle valve 20 is opened upon operation of an engine (not shown), air is introduced through the air intake passage 3 to the engine. In particular, when the degree of opening of the throttle valve 20 is large and the velocity of air flow in the venturi portion 3*a* is high, air in the negative pressure chamber 18 of the suction chamber 4 is intensively sucked through the suction hole 19 into the venturi portion 3*a*, thereby lowering the negative pressure in the negative pressure chamber 18, while pressure in the air chamber 15 of the suction chamber 4 is kept at substantially atmospheric pressure. Accordingly, the suction piston 5 is leftwardly moved as viewed in FIG. 1 against the biasing force of the compression spring 14 and the sectional area of the venturi portion 3*a* is increased. The leftward movement of the suction piston 5 is accompanied by the movement of the metering needle 8 in the same direction, thereby enlarging the annular clearance between the main jet 12 and the metering needle 8 and discharging a large amount of fuel from the main nozzle 9.

When the degree of opening of the throttle valve 20 is small, such as under engine idling conditions or at low-speed running and the velocity of air flow in the venturi portion 3*a* is low, air in the negative pressure chamber 18 is slightly sucked through the suction hole 19 into the venturi portion 3*a*. Accordingly, pressure in the negative pressure chamber 18 becomes nearly atmospheric and the suction piston 5 is rightwardly moved as viewed in FIG. 1 by the biasing force of the compression spring 14, and thus the head portion 7*a* of the small diameter portion 7 of the suction piston 5 approaches the main nozzle 9. As a result, the sectional area of the venturi portion 3*a* and the annular clearance between the main jet 12 and the metering needle 8 are decreased.

In the case of low velocity of the air flow in the venturi portion 3*a* as is described above, fuel to be discharged from the main nozzle 9 is hardly atomized and tends to deposit on the lower surface of the metering needle 8 in the liquid state and to flow along the needle 8 toward its base portion. As shown in FIG. 4A (idling operation) and FIG. 5A (low-speed running operation), the fuel flowing along the needle 8 is dripped down from the lower surface of the needle 8 and the lower end of the head portion 7*a* onto the throttle valve 20 and is then supplied to the engine. Because of this intermittent dripping down of the fuel, the amount of fuel to be supplied to the engine may not be kept uniform and the air-fuel ratio of fuel mixture becomes over-rich or lean. As a result, engine speed at idling becomes unstable or surging is induced, and in the worst case, engine stall may be occurred. Upon taking off of a vehicle, the entire upper surface of the throttle valve 20 is not wet with fuel as seen in FIG. 4A and therefore the air-fuel ratio of fuel mixture temporarily becomes lean, thereby causing unsatisfactory acceleration performance from idling.

SUMMARY OF THE INVENTION

Accordingly, it is an object of the present invention to provide a variable venturi carburetor which may stably supply fuel to the engine even at engine idling operation or low-speed engine running operation, thereby preventing variations in air-fuel ratio and achieving stable engine operation at idling and low-speed running.

It is another object of the present invention to provide a variable venturi carburetor which may improve accelerating performance after idling.

The variable venturi carburetor according to the invention includes a carburetor body, a float chamber, an air intake passage, a venturi portion provided in the air intake passage, a fuel passage communicating with the float chamber and the venturi portion, a main fuel jet provided in the fuel passage, a suction piston transversely movable with respect to the venturi portion in response to the load conditions of the engine and adapted to be slidably mounted in a cylindrical portion of the carburetor body and a fuel metering needle fixed at its base portion to the end of the suction piston and slidably inserted at its tip portion into the main jet for controlling the opening area of a fuel metering portion of the main fuel jet by reciprocating motion of the suction piston to vary the amount of fuel supplied through the main fuel jet to the air intake passage. The inventive feature is that the variable venturi carburetor as described above comprises an air passage provided in the suction piston, a needle mounting member provided at the head portion of the suction piston for mounting the fuel metering needle and an air discharging member provided at the needle mounting member, wherein the air passage communicates the air intake passage upstream of the venturi portion with the needle mounting member, and the needle mounting member is communicated with the venturi portion through the air discharging member.

With this arrangement, the fuel discharged from the main nozzle collides with the air spouted out from the air discharging member and is broken into small particles and is substantially uniformly dispersed in the air flowing in the venturi portion. Accordingly, at engine idling operation, the small particles of fuel are deposited on the upper surface of the throttle valve and the inside wall of the venturi portion and flow through the lower and upper clearances between the throttle valve and the inside wall of the air intake passage, being supplied to the engine. As a result, the air-fuel ratio of fuel mixture may be maintained constant and the following effects may be accomplished.

(1) Even when the air-fuel ratio of fuel mixture is leaner than is obtained with a conventional variable venturi carburetor, engine idling speeds may be stabilized to purify exhaust gas.

(2) Owing to the above-mentioned effect, engine idling speeds may be decreased and fuel consumption at idling may be reduced.

(3) As the upper surface of the throttle valve is sufficiently in wet state at idling, the air-fuel ratio of fuel mixture during acceleration does not become temporarily over-lean, thereby improving accelerating performance after idling.

The other objects and advantageous features of the invention will become more clear from the following description of the preferred embodiments taken in conjunction with the accompanying drawings.

DETAILED DESCRIPTION OF THE PREFERRED EMBODIMENTS

Figure 1:
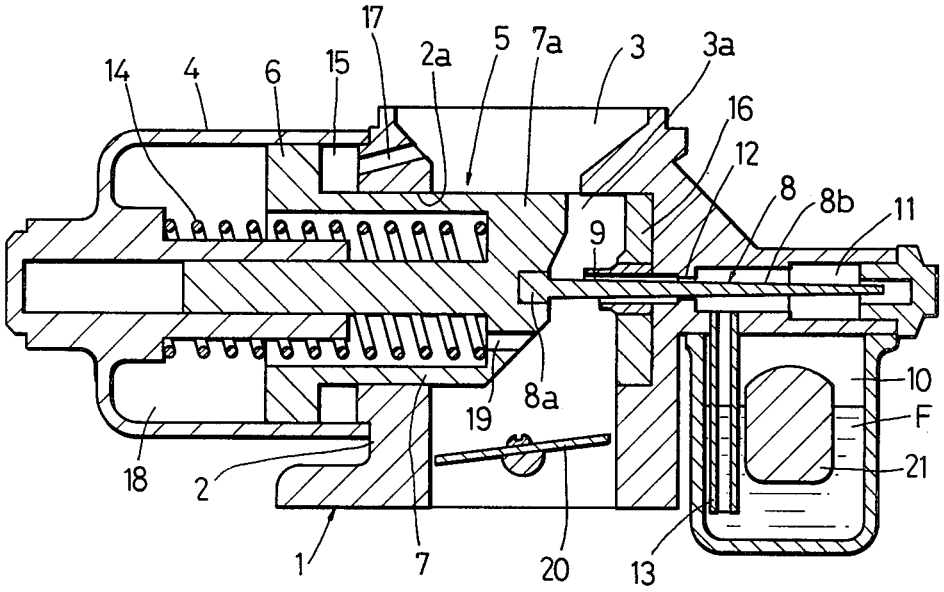
FIG. 1 is a vertical cross-sectional view of a conventional variable venturi carburetor.
Figure 2:
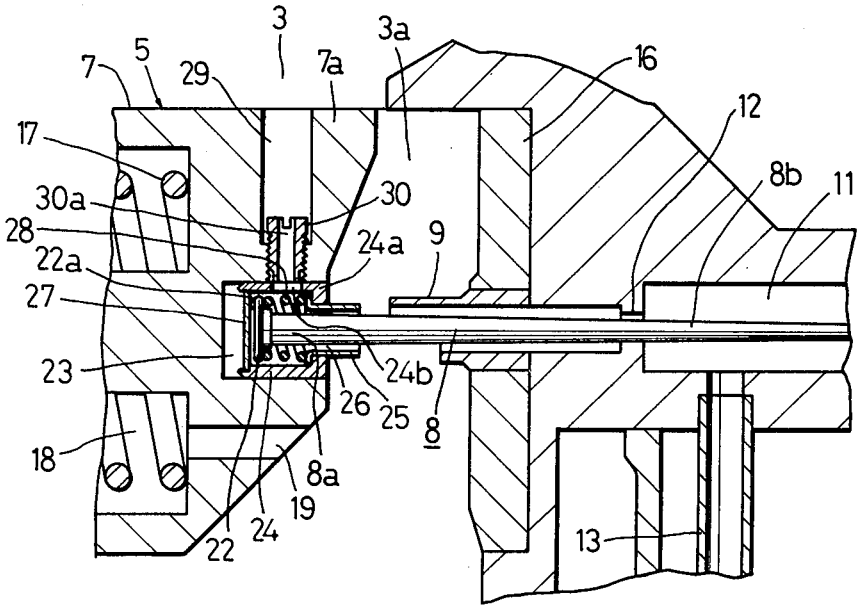
FIG. 2 is a vertical cross-sectional view of the venturi portion of the variable venturi carburetor according to the first embodiment of the present invention.

Referring now to FIG. 2 which shows a first embodiment of the invention, wherein like parts shown in FIG. 1 are given like numerals, the metering needle 8 is formed with a disc-like flange 22 at its end of the base portion 8*a*. The flange 22 is formed with a projection 22*a* on its opposed surface to the tip portion 8*b* of the needle 8. The head portion 7*a* of the suction piston 5 is provided with a lateral bore 23 into which a needle mount casing 24 is engaged and the flange 22 of the needle 8 is accommodated in the casing 24. The casing 24 is formed with a stopper 24*a* on the venturi portion 3*a* side thereof. An air discharging member 25 is fixed to the stopper 24*a* in such a manner as to allow an annular clearance 26 between the outer circumferential surface of the needle 8 and the inner circumferential surface of the air discharging member 25 and to project into the venturi portion 3*a*. A washer 27 is fixed by crimping to the left edge of the casing 24 as viewed in FIG. 2, and a compression spring 28 is interposed between the stopper 24*a* of the casing 24 and the flange 22 of the needle 8 and serves to urge the flange 22 against the washer 27. As the flange 22 is formed with the projection 22*a*, the flange 22 is tilted relative to the washer 27 by the biasing force of the compression spring 28 and the needle 8 is eccentrically supported by the main jet 12.

The small diameter portion 7 of the suction piston 5 is provided with an air passage 29 communicating with the air intake passage 3 upstream of the venturi portion 3*a* and the lateral bore 23. A hollowed screw 30 having a central aperture 30*a* is screwed into the lowermost portion of the air passage 29 opening into the lateral bore 23, so as to fix the casing 24 to the lateral bore 23. The casing 24 is further provided with an upper opening 24*b* communicating through the central aperture 30*a* of the screw 30 with the air passage 29.

With this arrangement, when intake air is introduced into the air intake passage 3 of the carburetor body 1 by the engine operation, the air flows through the venturi portion 3*a* as well as a part of the air is introduced into the air passage 29, the central aperture 30*a* of the screw 30, the upper opening 24*b* of the casing 24 and is spouted out from the casing 24 through the annular clearance 26 between the air discharging member 25 and the needle 8 into the venturi portion 3*a*. As will be apparent from FIG. 4B, at engine idling operation, the fuel discharged from the main nozzle 9 along the needle 8 collides with the air spouted out from the annular clearance 26 and is broken into small particles and is dispersed in the air flowing in the venturi portion 3*a*. This particulate fuel is formed into finer particles when it passes through a lower and an upper clearance S1 and S2 between the inside surface of the bore 2 and the throttle valve 20, and then is supplied into the engine. Accordingly, the air-fuel ratio of fuel mixture is not varied and the engine idling operation may be stabilized.

For the above reason, even if the amount of fuel metered by the main jet 12 at idling is smaller than has been heretofore obtained with a conventional variable venturi carburetor, stability of the idle operation may be ensured, so that the air-fuel ratio at idling may become lean, thus improving fuel consumption.

Figure 4A:
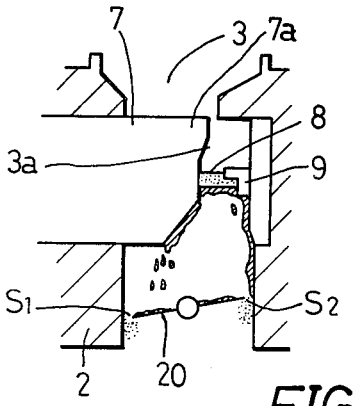
FIGS. 4A and 4B show fuel atomization at engine idling operation in the prior art and the present invention, respectively.
Figure 4B:
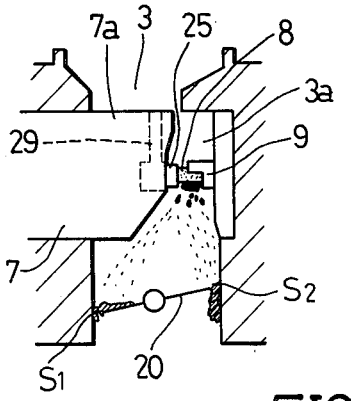

Since the small particles of fuel formed at idling are deposited on the upper surface of the throttle valve 20 or the inside wall of the venturi portion 3*a* as shown in FIG. 4B, the air-fuel ratio of fuel mixture to be sucked into the engine may not temporarily become over-lean, thereby preventing stumble or stall of the engine during acceleration.

Figure 5A:
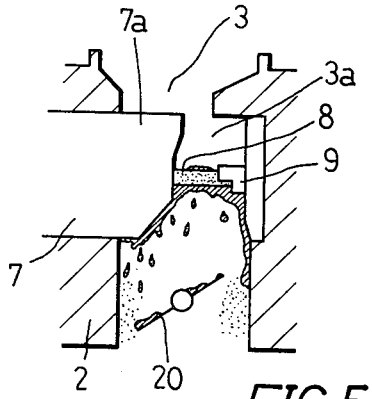
FIGS. 5A and 5B show fuel atomization at engine low-speed operation in the prior art and the present invention, respectively.
Figure 5B:
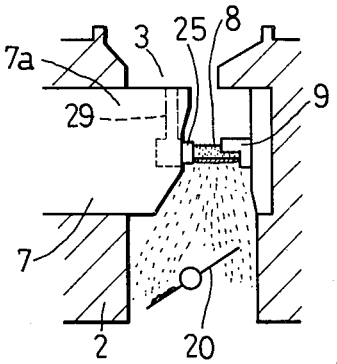
Figure 6A:
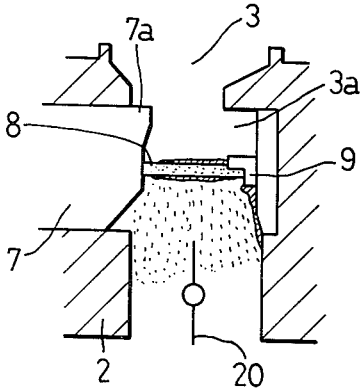
FIGS. 6A and 6B show fuel atomization at engine high-speed operation in the prior art and the present invention, respectively.
Figure 6B:
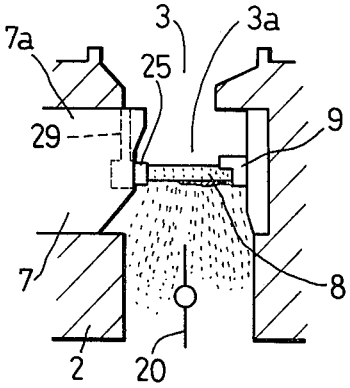

As shown in FIGS. 5A and 5B illustrating an engine low-speed operation and FIGS. 6A and 6B illustrating an engine high-speed operation, fuel atomization achieved by the present invention (FIGS. 5B and 6B) is superior to that obtained with a conventional variable venturi carburetor (FIGS. 5A and 6A).

Figure 3:
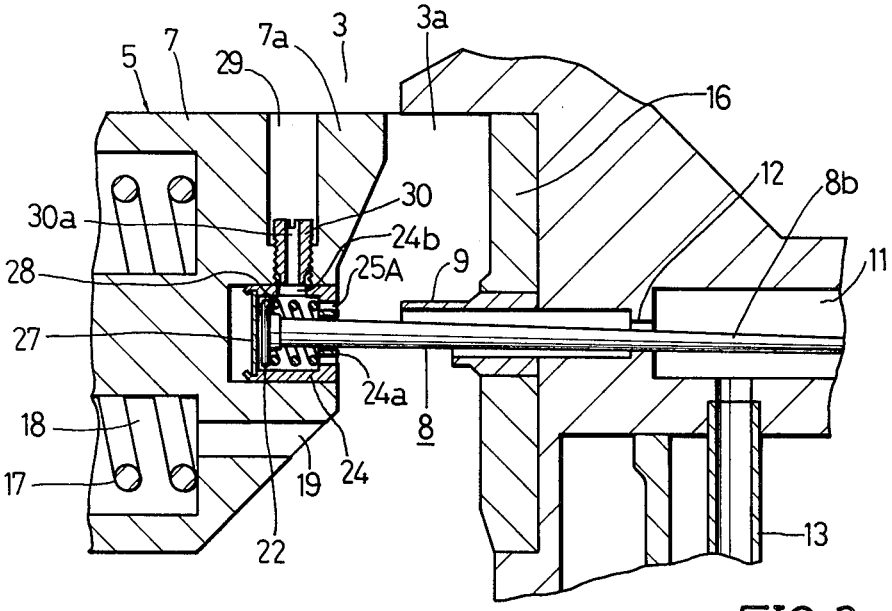
FIG. 3 is a vertical cross-sectional view similar to FIG. 2, according to the second embodiment of the present invention.

Referring to FIG. 3 which shows a second embodiment of the invention, the stopper 24*a* of the casing 24 is provided with a suitable number of air discharge openings 25A in place of the air discharging member 25 in the first embodiment. The operation and effect of the air discharge openings 25A is the same as with the air discharging member 25 in the first embodiment.

While the invention has been described with reference to a few preferred embodiments thereof, it is to be understood that modifications or variations may be easily made without departing from the scope of this invention which is defined by the appended claims.

What is claimed is:

1. In combination with a variable venturi carburetor for an internal combustion engine in an automobile having a carburetor body, a float chamber, an air intake passage, a venturi portion provided in said air intake passage, a fuel passage communicating with said float chamber and said venturi portion, a main fuel jet provided in said fuel passage, a suction piston transversely movable with respect to said venturi portion in response to the load conditions of the engine and adapted to be slidably mounted in a cylindrical portion of said carburetor body and a fuel metering needle fixed at its base portion to the end of said suction piston and slidably inserted at its tip portion into said main jet for controlling the opening area of a fuel metering portion of said main fuel jet by reciprocating motion of said suction piston to vary the amount of fuel supplied through said main fuel jet to said air intake passage; the improvement comprising an air passage provided in said suction piston, a needle mounting member provided at the head portion of said suction piston for mounting said fuel metering needle and an air discharging member provided at said needle mounting member, said air passage communicating said air intake passage upstream of said venturi portion with said needle mounting member, said needle mounting member being communicated with said venturi portion through said air discharging member.

2. The variable venturi carburetor as defined in claim 1 and further comprising a screw having a central through-hole threadedly engaged with the outlet portion of said air passage for fixing said needle mounting member, whereby said central through-hole of said screw communicates said air passage with said needle mounting member.

3. The variable venturi carburetor as defined in claim 1, wherein said needle mounting member is formed with a stopper on said venturi portion side.

4. The variable venturi carburetor as defined in claim 3, wherein said air discharging member is fixed to said stopper and projects into said venturi portion along said fuel metering needle.

5. The variable venturi carburetor as defined in claim 3, wherein said air discharging member is a suitable number of through-holes opened through said stopper.

6. The variable venturi carburetor as defined in claim 1, wherein said fuel metering needle is formed with a flange at its base.

7. The variable venturi carburetor as defined in claim 3 or 6 and further comprising a compression spring interposed between said stopper and said flange for normally biasing against said flange.

* * * * *